US009588467B2

(12) United States Patent
Takada

(10) Patent No.: US 9,588,467 B2
(45) Date of Patent: Mar. 7, 2017

(54) IMAGE FORMING APPARATUS

(71) Applicant: Konica Minolta, Inc., Chiyoda-ku, Tokyo (JP)

(72) Inventor: Mikihiko Takada, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/988,985

(22) Filed: Jan. 6, 2016

(65) Prior Publication Data

US 2016/0202648 A1 Jul. 14, 2016

(30) Foreign Application Priority Data

Jan. 14, 2015 (JP) ..... 2015-004906

(51) Int. Cl.
*G03G 15/20* (2006.01)
*G03G 15/00* (2006.01)

(52) U.S. Cl.
CPC ..... *G03G 15/2032* (2013.01); *G03G 15/5029* (2013.01); *G03G 15/652* (2013.01); *G03G 2215/00738* (2013.01)

(58) Field of Classification Search
None
See application file for complete search history.

(56) References Cited

U.S. PATENT DOCUMENTS 5,713,059 A * 1/1998 Ishikawa ..... B41J 29/393 226/100
2010/0295241 A1* 11/2010 Isogai ..... B65H 9/006 271/227
2011/0194861 A1* 8/2011 Shiraishi ..... B65H 26/02 399/21
2012/0230719 A1* 9/2012 Matsumoto ..... G03G 15/2042 399/69

FOREIGN PATENT DOCUMENTS

JP 62161156 A * 7/1987
JP 06250541 A * 9/1994
JP 2007-041370 A 2/2007
JP 2008233770 A * 10/2008

* cited by examiner

*Primary Examiner* — David Gray
*Assistant Examiner* — Thomas Giampaolo, II
(74) *Attorney, Agent, or Firm* — Squire Patton Boggs (US) LLP

(57) ABSTRACT

An image forming apparatus which can prevent deformation of a sheet due to heat generated at a fixing section as much as possible, and can reduce the amount of waste paper even when the sheet is partially deformed, in which: an upper fixing section and a lower fixing section form a fixing nip for conveying a continuous sheet in a tightly sandwiching manner in a state where the upper fixing section and the lower fixing section are in pressure contact with each other; the upper fixing section and the lower fixing section are separated from each other when image formation is not performed; and a detection section detects deformation of the continuous sheet at a closest part between the upper fixing section and the lower fixing section.

18 Claims, 14 Drawing Sheets

IMAGE FORMING APPARATUS

CROSS REFERENCE TO RELATED APPLICATIONS

This application is entitled to and claims the benefit of Japanese Patent Application No. 2015-004906, filed on Jan. 14, 2015, the disclosure of which including the specification, drawings and abstract is incorporated herein by reference in its entirety.

BACKGROUND OF THE INVENTION

1. Field of the Invention

The present invention relates to an image forming apparatus, an image formation system and a fixing device.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to the sheet, and thereafter fixed through heating and pressing at a fixing nip of a heating member (for example, a heating roller) and a pressing member (for example, a pressure roller), thereby forming an image on the sheet.

Conventionally, image formation systems have been practically used in which a sheet feeding apparatus that feeds a continuous sheet such as continuous roll paper and folded paper is connected at the preceding side of the image forming apparatus, and a winding apparatus that winds up the sheet on which an image has been formed by the image forming apparatus is connected at the succeeding side of the image forming apparatus.

At a fixing section (the part for fixation by heating and pressing the sheet on which a toner image is transferred) of the above-mentioned image forming apparatus, a sheet is present between the heating member and the pressing member even in a non-image formation period such as a standby period and a warming-up period which are not included in the image formation period. The sheet does not make contact with the heating member during the non-image formation period when the image forming apparatus has a member for separating the heating member and the pressing member, but may be deformed under the influence of the heat of the heating member since the sheet is stopped. In general, the heating member is configured to be rotatable even during the non-image formation period. As such, when the sheet is deformed under the influence of the heat of the heating member, the deformed part may make contact with the heating member and damage the heating member, and this damage may result in the damage on the image. In addition, sheet winding jam in which the heating member draws the sheet may be caused.

As described, in image forming apparatuses, the sheet may be deformed under the influence of the heat of the heating member during the non-image formation period, and when the sheet is deformed, the heating member may be damaged, or the sheet winding jam in which the heating member draws the sheet may be caused.

To solve such a problem, a method has been devised in which the heat is prevented from concentrating at one point on the sheet by moving the sheet during the non-image formation period. Such a technique is disclosed in Japanese Patent Application Laid-Open No. 2008-233770 and Japanese Patent Application Laid-Open No. 2007-041370, for example.

Japanese Patent Application Laid-Open No. 2008-233770 discloses a technique in which a conveyance roller pair for fixation provided on the downstream side in the sheet conveyance direction is driven/stopped in the sheet stopping period in which printing is not performed so as to convey the sheet in the conveyance direction at given intervals, whereby discoloration and deformation of the sheet due to heat in the fixation step is prevented.

Japanese Patent Application Laid-Open No. 2007-041370 discloses a technique in which a continuous conveyance mode for continuously conveying the sheet to the downstream side of the conveyance path, a conveyance stopping mode for stopping the sheet in the inserted state on the conveyance path, and a reciprocation mode for reciprocating the sheet on the conveyance path such that a certain part of the sheet is prevented from making contact with a certain member in a stopping state are provided. In this technique, the mode is switched to the continuous conveyance mode during image formation on the sheet, the mode is switched to the conveyance stopping mode when the image formation to the sheet is terminated, and the mode is switched to the reciprocation mode at a time point during the non-image formation period, whereby the amount of deformation of the sheet is reduced.

However, in the technique disclosed in Japanese Patent Application Laid-Open No. 2008-233770, if the sheet conveyance stopping period is fixed to a certain period, the sheet may disadvantageously be conveyed more than necessary and wasted, or deformation or discoloration of the sheet may disadvantageously be caused due to an excessively long sheet conveyance stopping period since the sheet conveyance stopping period for preventing heat deformation and discoloration of the sheet differs depending on the type of the sheet. This problem may be solved by changing the sheet conveyance stopping period in accordance with the type of the sheet; however, then the type has to be determined in advance, and consequently the setting is disadvantageously complicated.

In the technique disclosed in Japanese Patent Application Laid-Open No. 2007-041370, disadvantageously, reciprocation may be performed by an excessive length and consequently the sheet may be damaged and wasted, or the conveyance speed may be excessively slow and consequently the sheet may be deformed by heat, since the conditions such as the switching time from the stopping mode to the reciprocation mode for preventing the heat deformation, and the conveyance speed and the reciprocation length of the reciprocation mode are different depending on the type of the sheet.

As described, in the above-described two conventional techniques, the sheet is only simply moved, and the sheet is wasted by the amount of the movement if the sheet is needlessly moved.

Moreover, since the sheet has been damaged to some degree, the damaged part still cannot be used even after the sheet is needlessly moved.

SUMMARY OF THE INVENTION

An object of the present invention is to provide an image forming apparatus, an image formation system and a fixing device which can reduce the deformation of the sheet due to the heat generated at the fixing section as much as possible, and can reduce the amount of the waste paper even when the sheet is deformed by heat.

To achieve the above-described objects, an image forming apparatus according to an aspect of the present invention includes: an upper fixing section disposed on a fixing side of a continuous sheet on which a toner image is formed; a lower fixing section configured to form a fixing nip for conveying the continuous sheet in a tightly sandwiching manner in a state where the lower fixing section makes pressure contact with the upper fixing section; a pressure contact separation section configured to bring the upper fixing section and the lower fixing section into pressure contact with each other or separate the upper fixing section and the lower fixing section from each other; a control section configured to control the pressure contact separation section to separate the upper fixing section and the lower fixing section from each other during a non-image formation period; and a detection section configured to detect deformation of the continuous sheet at a closest part between the upper fixing section and the lower fixing section during the non-image formation period.

An image formation system according to another aspect of the present invention includes: a sheet feeding apparatus configured to feed a continuous sheet; the image forming apparatus configured to form an image on the continuous sheet fed from the sheet feeding apparatus; and a winding apparatus configured to wind up the continuous sheet on which an image is formed by the image forming apparatus.

A fixing device according to another aspect of the present invention includes: an upper fixing section disposed on a fixing side of a continuous sheet on which a toner image is formed; a lower fixing section configured to form a fixing nip for conveying the continuous sheet in a tightly sandwiching manner in a state where the lower fixing section makes pressure contact with the upper fixing section; a pressure contact separation section configured to bring the upper fixing section and the lower fixing section into pressure contact with each other or separate the upper fixing section and the lower fixing section from each other; a control section configured to control the pressure contact separation section to separate the upper fixing section and the lower fixing section from each other during a non-image formation period; and a detection section configured to detect deformation of the continuous sheet at a closest part between the upper fixing section and the lower fixing section during the non-image formation period.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, the present embodiment is described in detail with reference to the drawings.

Figure 1:
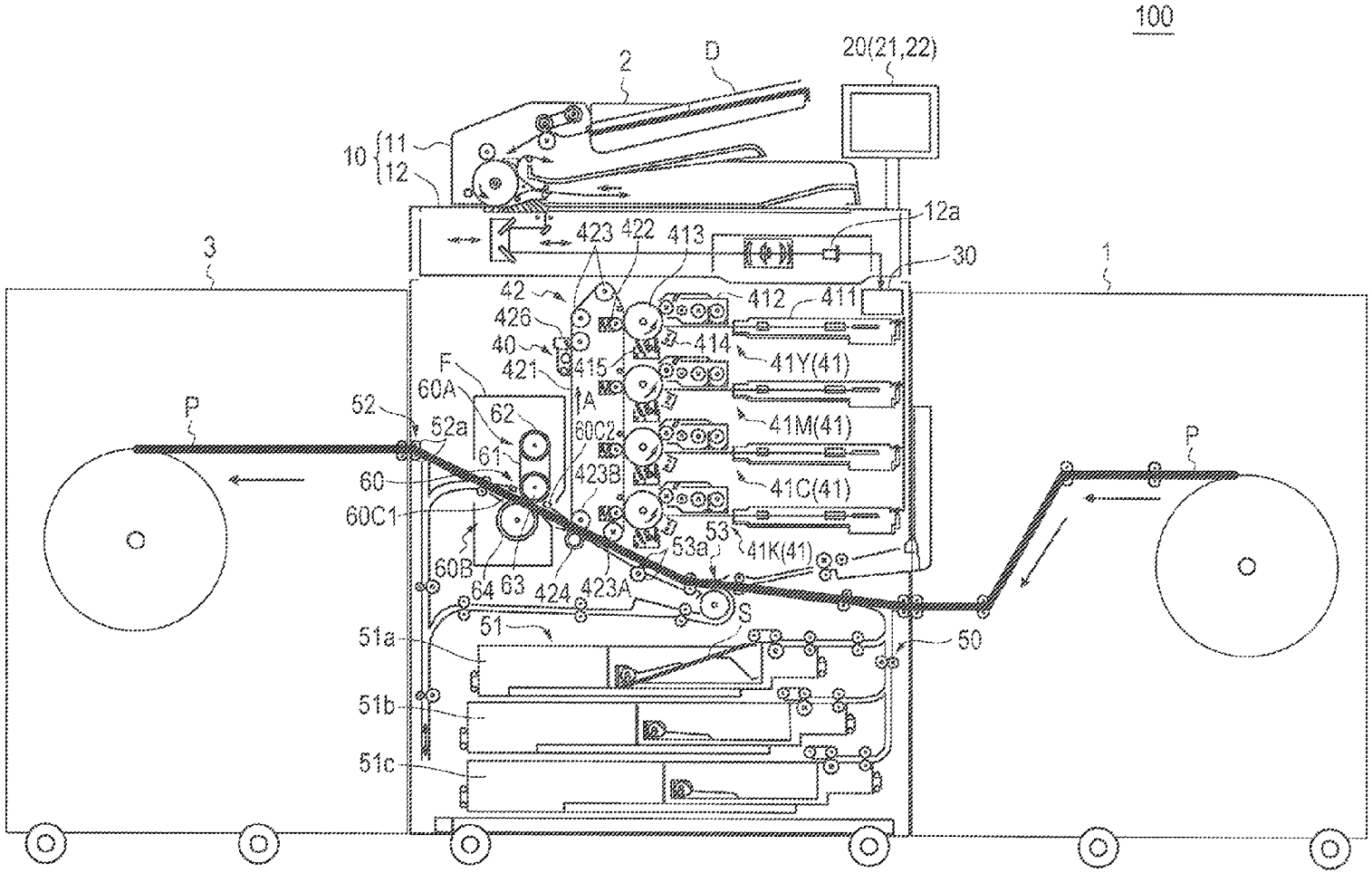
FIG. 1 schematically illustrates a general configuration of an image formation system according to an embodiment.
Figure 2:
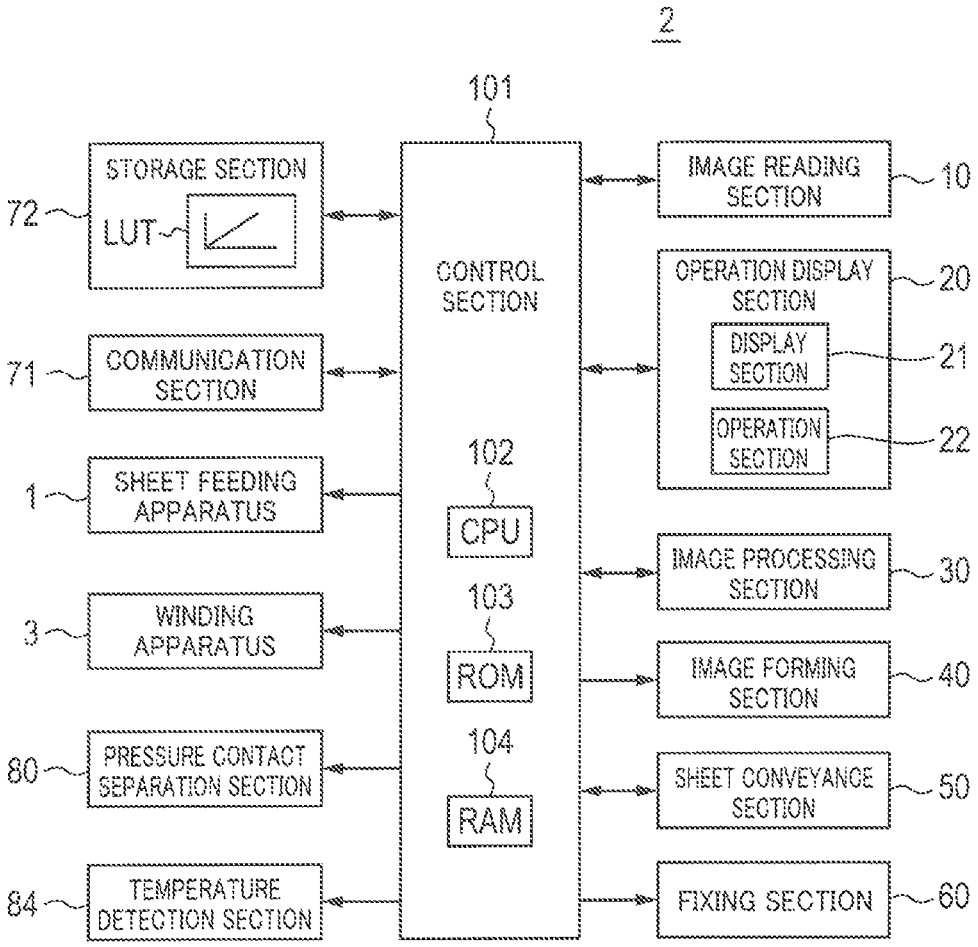
FIG. 2 illustrates a principal part of a control system of the image forming apparatus of the image formation system according to the embodiment.

FIG. 1 schematically illustrates a general configuration of image forming system 100 according to an embodiment of the present invention. FIG. 2 illustrates a principal part of a control system of image forming apparatus 2 of image formation system 100 according to the present embodiment. Image forming system 100 uses continuous sheet P or sheet S (non-continuous sheet) indicated with the heavy line in FIG. 1 as a recording medium, and forms an image on continuous sheet P or sheet S. Here, continuous sheet P refers to a continuous sheet such as continuous roll paper and folded paper, on which an image having a predetermined length in the conveyance direction is formed and which is cut in the post-processing.

As illustrated in FIG. 1, in image forming system 100, sheet feeding apparatus 1, image forming apparatus 2 and winding apparatus 3 are connected to each other from the upstream side in the conveyance direction of continuous sheet P (hereinafter referred to also as "sheet conveyance direction"). Sheet feeding apparatus 1 and winding apparatus 3 are used when an image is formed on continuous sheet P.

Sheet feeding apparatus 1 is an apparatus for feeding continuous sheet P to image forming apparatus 2. As illustrated in FIG. 1, in the housing of sheet feeding apparatus 1, roll-shaped continuous sheet P is wound around a support shaft and is rotatably held. Sheet feeding apparatus 1 conveys, via a plurality of conveyance roller pairs (for example, delivery rollers, sheet feed rollers and the like), continuous sheet P wound around the support shaft to image forming apparatus 2 at a constant speed. The sheet feeding operation of sheet feeding apparatus 1 is controlled by control section 101 (see FIG. 2) of image forming apparatus 2.

It is to be noted that, in sheet feeding apparatus 1, continuous sheet P may not be held in a roll form, and may be held in a folded state.

Image forming apparatus 2 is a color-image forming apparatus of an intermediate transfer system using electrophotographic process technology. That is, image forming apparatus 2 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 transfers (secondary-transfers) the resultant image to continuous sheet P fed from sheet feeding apparatus 1 or sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60, pressure contact separation section 80, temperature detection section 84, and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on continuous sheet P or sheet S on the basis of the image data (input image data). Communication section 71 is composed of, for example, a communication control card such as a LAN card.

Image reading section 10 includes auto document feeder (ADF) 11, document image scanning device 12 (scanner) which are illustrated in FIG. 1, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

In FIG. 2, operation display section 20 includes, for example, a liquid crystal display (LCD) with a touch panel, and functions as display section 21 and operation section 22. Controls display section 21 to displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to continuous sheet P or sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when continuous sheet P or sheet S passes through the secondary transfer nip, the toner image on intermediate transfer belt 421 is secondary-transferred to continuous sheet P or sheet S. To be more specific, a secondary transfer bias is applied to secondary transfer roller 424, and an electric charge of the polarity opposite to the polarity of the toner is applied to the rear side (the side that makes contact with secondary transfer roller 424) of continuous sheet P or sheet S, whereby the toner image is electrostatically transferred to continuous sheet P or sheet S. Continuous sheet P or sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes: upper fixing section 60A having a fixing side member disposed on a fixing surface (the surface on which a toner image is formed) side of continuous sheet P or sheet S; lower fixing section 60B having a back side supporting member disposed on the rear surface (the surface opposite to the fixing surface) side of continuous sheet P or sheet S; detection section 60C configured to detect partial deformation of a sheet; and the like. The back side supporting member is brought into pressure contact with the fixing side member, whereby a fixing nip for conveying continuous sheet P or sheet S in a tightly sandwiching manner is formed.

Fixing section 60 applies, at the fixing nip, heat and pressure to continuous sheet P or sheet S on which a toner image has been secondary-transferred, thereby fixing the toner image on continuous sheet P or sheet S. Fixing section 60 is disposed as a unit in fixing part F. In addition, fixing part F may be provided with an air-separating unit that blows air to separate continuous sheet P or sheet S from the fixing side member or the back side supporting member.

Upper fixing section 60A includes endless fixing belt 61, heating roller 62 and fixing roller 63, which serve as a fixing side member (belt heating system). Fixing belt 61 is installed in a stretched state around heating roller 62 and fixing roller 63 with a predetermined belt tensile force (for example, 40 [N]).

Fixing belt 61 makes contact with continuous sheet P or sheet S on which a toner image is formed, and thermally fixes the toner image on continuous sheet P or sheet S at a fixation temperature (for example, 160 to 200[° C.]). The fixing temperature is a temperature at which a heat energy required for melting the toner on continuous sheet P or sheet S can be obtained, and the fixing temperature differs depending on factors such as the type of continuous sheet P or sheet S on which an image is to be formed.

Heating roller 62 incorporates a heating source (halogen heater) and applies heat to fixing belt 61. The temperature of a heating source is controlled by control section 101. The heating source applies heat to heating roller 62, and as a result, fixing belt 61 is heated.

Fixing roller 63 is driven and controlled (for example, turn on/off of rotation, circumferential velocity, and the like) by control section 101. Control section 101 rotates fixing roller 63 in the clockwise direction. When fixing roller 63 rotates, fixing belt 61 and heating roller 62 rotate in the clockwise direction to follow the rotation of fixing roller 63.

Lower fixing section 60B includes pressure roller 64 serving as a back side supporting member (roller pressing type). Pressure roller 64 has a structure in which an elastic layer made of silicone rubber or the like and a surface layer composed of a PFA-tube are sequentially formed on the outer peripheral surface of a cylindrical mandrel made of iron or the like, for example. Pressure roller 64 is brought into pressure contact with fixing roller 63 with fixing belt 61 therebetween with a predetermined fixing load (for example, 1000 [N]) by pressure contact separation section 80 (see FIG. 2). Pressure contact separation section 80 has a conventional configuration, and brings fixing belt 61 and pressure roller 64 into pressure contact with each other or separates fixing belt 61 and pressure roller 64 from each other. Thus, a fixing nip for conveying continuous sheet P or sheet S in a tightly sandwiching manner is formed between fixing belt 61 and pressure roller 64. Control section 101 drives and controls pressure roller 64 (for example, on/off of rotation, circumferential velocity, and the like) and pressure contact separation section 80. Control section 101 rotates pressure roller 64 in the counterclockwise direction.

Figure 3B:
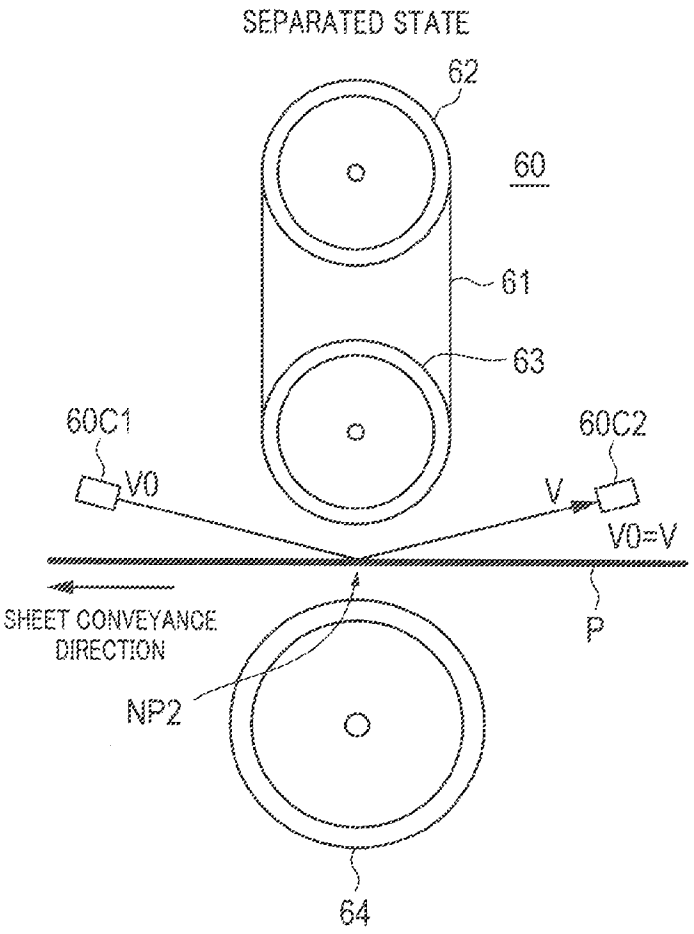
FIG. 3B illustrates a state where the fixing belt and the pressure roller are separated from each other.
Figure 3A:
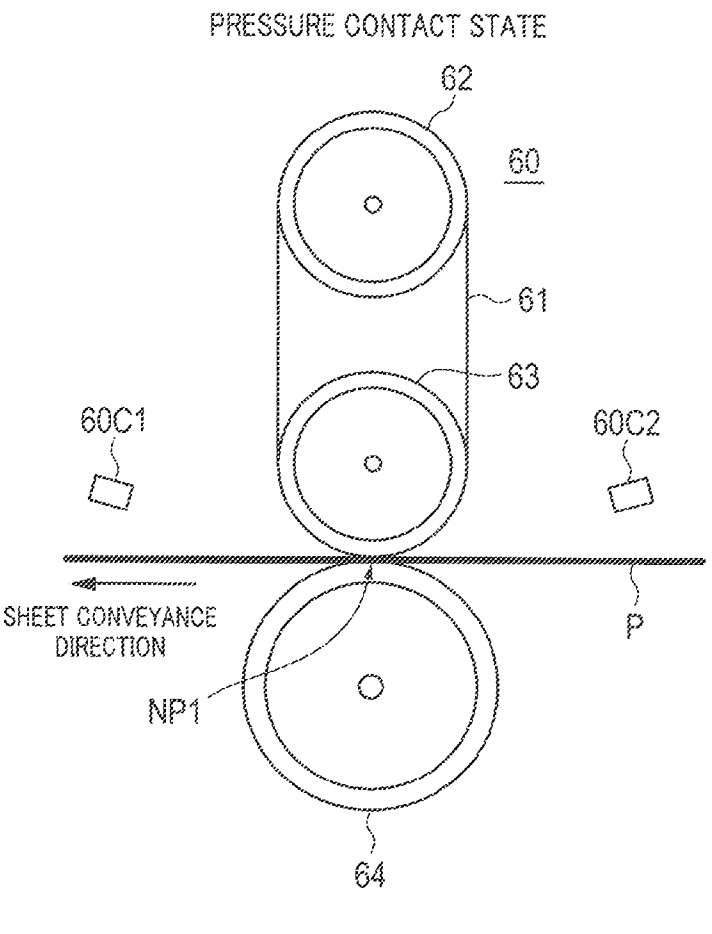
FIG. 3A illustrates a state where a fixing belt and a pressure roller are in pressure contact with each other.

FIGS. 3A and 3B illustrate a pressure contact state and a separated state of fixing belt 61 and pressure roller 64. FIG. 3A illustrates a pressure contact state, and FIG. 3B illustrates a separated state.

As illustrated in FIG. 3A, during conveyance of continuous sheet P, pressure contact separation section 80 brings fixing belt 61 and pressure roller 64 into pressure contact with each other under the control of control section 101. In this manner, fixing nip NP 1 is formed. In addition, as illustrated in FIG. 3B, when the conveyance of continuous sheet P is stopped, pressure contact separation section 80 separates fixing belt 61 and pressure roller 64 from each other under the control of control section 101. The closest position between fixing belt 61 and pressure roller 64 at this time is closest part NP2.

Detection section 60C includes transmission section 60C1 configured to continuously output a "H" level signal, and reception section 60C2 configured to receive the signal output from transmission section 60C1. The signal output from transmission section 60C1 utilizes light such as visible light, infrared light, and laser light. It is possible to use sound such as ultrasound waves instead of light. Transmission section 60C1 is disposed on the downstream side (on the left side in the drawing) relative to upper fixing section 60A and lower fixing section 60B in the sheet conveyance direction, and reception section 60C2 is disposed on the upstream side (on the right side in the drawing) relative to upper fixing section 60A and lower fixing section 60B in the sheet conveyance direction. In addition, transmission section 60C1 is angled such that the output direction of the signal is oblique to continuous sheet P at closest part NP2, and reception section 60C2 is angled at an angle at which the signal reflected at a part located at closest part NP2 of continuous sheet P can be received. This configuration in which transmission section 60C1 and reception section 60C2 are disposed so as to form a V-shaped signal propagation path turning at closest part NP2 is advantageous in that the degree of freedom of installation of transmission section 60C1 and reception section 60C2 is high in comparison with the installation modification described later. As illustrated in FIG. 3B, the signal output from transmission section 60C1 is reflected at the part located at closest part NP2 of continuous sheet P, and the reflected signal enters reception section 60C2. In this case, when a member that diffuses or shields the signal output from transmission section 60C1 is not present, transmission signal intensity V0 at transmission section 60C1 and reception signal intensity V at reception section 60C2 are equal to each other (V=V0).

FIG. 3B illustrates a flow of a signal in the case where the part located at closest part NP2 of continuous sheet P is not deformed. When that part is deformed, the signal output from transmission section 60C1 is diffused or shielded by that part, and reception signal intensity V at reception section 60C2 is reduced. Thus, the deformation of the part located at closest part NP2 of continuous sheet P can be detected by monitoring the reception signal intensity V at reception section 60C2.

Figure 4:
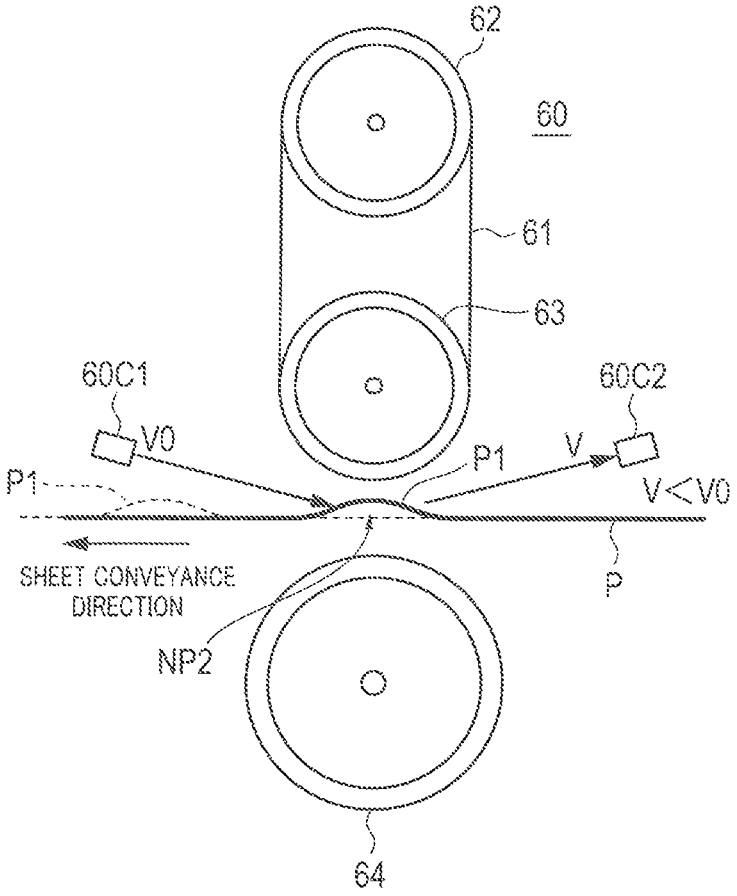
FIG. 4 illustrates a state of a signal between a transmission section and a reception section in the case where a continuous sheet is deformed at a closest part in the state where the transmission section and the reception section of a detection section are disposed as illustrated in FIG. 3A and FIG. 3B.

FIG. 4 illustrates a state of a signal between transmission section 60C1 and reception section 60C2 when the part located at closest part NP2 of continuous sheet P is deformed in the case where transmission section 60C1 and reception section 60C2 of detection section 60C are disposed as illustrated in FIG. 3. As illustrated in FIG. 4, when the deformation of the part located at closest part NP2 of continuous sheet P is caused, the signal output from transmission section 60C1 is diffused or shielded at deformed part P1, and consequently reception signal intensity V at reception section 60C2 is reduced. As described above, transmission signal intensity V0 at transmission section 60C1 and reception signal intensity V at reception section 60C2 are equal to each other (V=V0) when the part located at closest part NP2 of continuous sheet P is not deformed, but reception signal intensity V at reception section 60C2 is smaller than transmission signal intensity V0 at transmission section 60C1 (V<V0) when the part located at closest part NP2 of continuous sheet P is deformed.

It is possible to adopt a method in which a signal that travels parallel to continuous sheet P immediately above the continuous sheet P and passes through closest part NP2 is diffused or shielded by the deformed part of continuous sheet P to thereby detect deformation of the sheet, instead of the method in which a signal is actively applied to the part located at closest part NP2 of continuous sheet P to detect deformation of continuous sheet P on the basis of the amount of the reflection.

Figure 5:
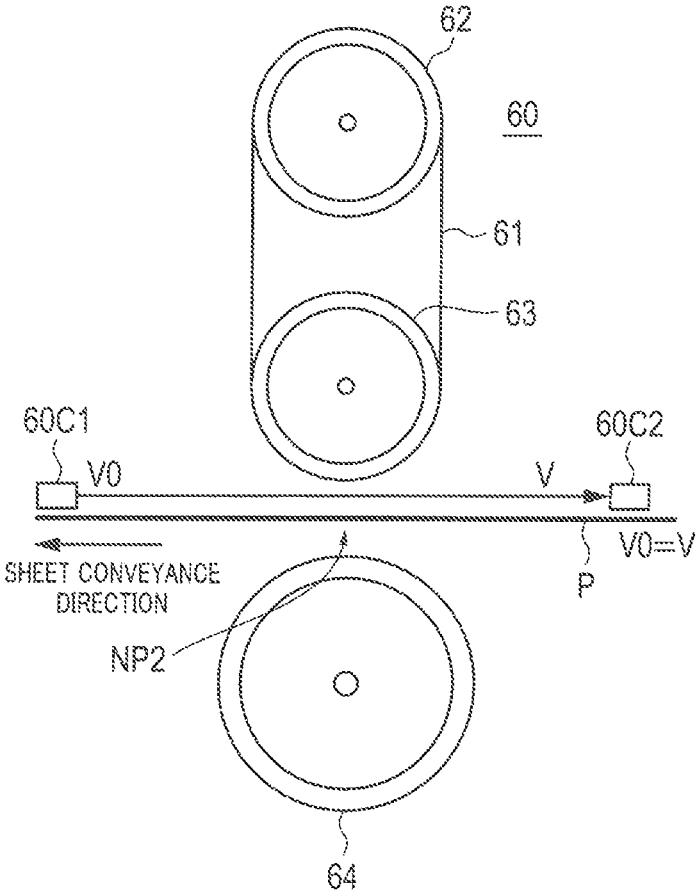
FIG. 5 illustrates an example in which a signal is advanced parallel to and immediately above the sheet to detect deformation of the sheet.

FIG. 5 illustrates an installation modification in which a signal is advanced parallel to and immediately above the sheet to detect deformation of the sheet. As illustrated in FIG. 5, transmission section 60C1 of detection section 60C is disposed at a position immediately above the sheet and on the downstream side relative to closest part NP2 in the sheet conveyance direction from which a signal is output toward closest part NP2, and reception section 60C2 of detection section 60C is disposed at a position on the upstream side relative to closest part NP2 in the sheet conveyance direction and immediately above the sheet at which the signal that has passed through closest part NP2 is received. The distances from the surface of the sheet of transmission section 60C1 and reception section 60C2 are equal to each other. This configuration in which transmission section 60C1 and reception section 60C2 are disposed such that a signal propagation path parallel to continuous sheet P is formed is advantageous in that deformation of continuous sheet P can be detected not only at closest part NP2 but also at positions preceding and succeeding closest part NP2 in the region between transmission section 60C1 and reception section 60C2. In addition, this configuration is advantageous in that deformation can be perceived with high sensitivity since, when continuous sheet P is not deformed, light does not impinge on continuous sheet P and the amount of diffusing light is small. When the part located at closest part NP2 of continuous sheet P is not deformed, transmission signal intensity V0 at transmission section 60C1 and reception signal intensity V at reception section 60C2 are equal to each other (V=V0).

Figure 6:
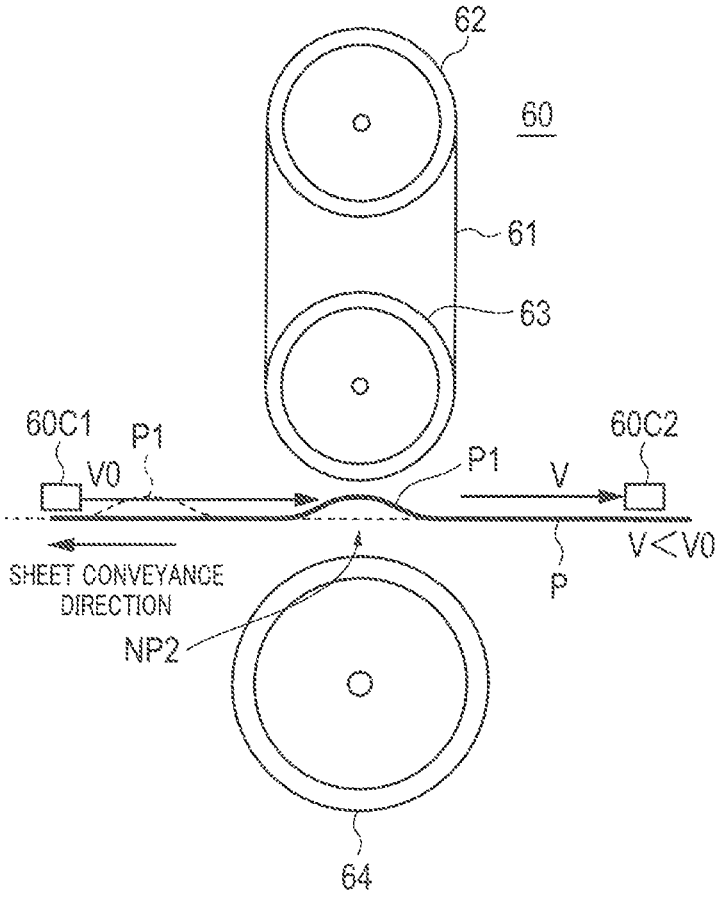
FIG. 6 illustrates a state of a signal between the transmission section and the reception section in the case where a continuous sheet is deformed at the closest part in the state where the transmission section and the reception section of the detection section are disposed as illustrated in FIG. 5.

FIG. 6 illustrates a state of a signal between transmission section 60C1 and reception section 60C2 when the part located at closest part NP2 of continuous sheet P is deformed in the case where transmission section 60C1 and reception section 60C2 of detection section 60C are disposed as illustrated in FIG. 5. As illustrated in FIG. 6, when the deformation of the part located at closest part NP2 of continuous sheet P is caused, the signal output from transmission section 60C1 is diffused or shielded by deformed part P1, and reception signal intensity V at reception section 60C2 is reduced. That is, in this case, reception signal intensity V at reception section 60C2 is smaller than transmission signal intensity V0 at transmission section 60C1 (V<V0).

Figure 14:
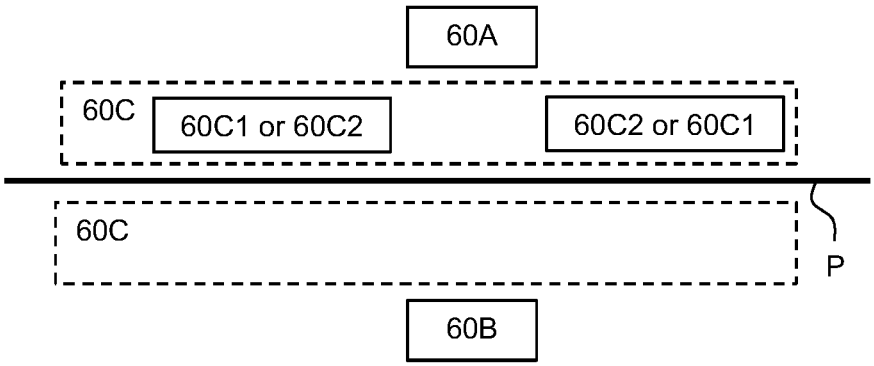
FIG. 14 is a schematic diagram showing exemplary locations for the transmission and reception sections.

With reference to FIG. 14, while transmission section 60C1 and reception section 60C2 are disposed on the downstream side and the upstream side, respectively, in the present embodiment, transmission section 60C1 and reception section 60C2 may also be disposed on the upstream side and the downstream side, respectively.

In addition, with reference to FIG. 14, while detection section 60C is disposed on the side nearer to upper fixing section 60A on the assumption that the sheet is deformed toward upper fixing section 60A side on which the heating source is provided in the present embodiment, it is preferable to dispose detection section 60C on lower fixing section 60B side when the sheet is deformed toward lower fixing section 60B. In addition, it is preferable to dispose detection section 60C on upper fixing section 60A side as well as on lower fixing section 60B side in the case where both upper fixing section 60A and lower fixing section 60B have the heating source and the sheet can be deformed toward sheet upper fixing section 60A and toward lower fixing section 60B, for example.

In addition, in the present embodiment, detection section 60C may be disposed in proximity to the sheet as in the installation modification of FIG. 5, and when such a configuration is employed, it is preferable to employ a structure in which detection section 60C is moved away from the sheet at the time of image formation.

While one detection section 60C is used in the present embodiment, the number of detection section 60C is not limited to one, and a plurality of detection section 60C may be used.

Control section 101 operates detection section 60C during a non-image formation period (during a standby period and a warming-up period which are not included in the image formation period) to detect the deformation of the part located at closest part NP2 of continuous sheet P. When deformation of that part is detected, control section 101 performs a control for preventing the defect due to the deformation (defect prevention control). The defect due to deformation of the sheet includes defects of fixing section 60 which are caused when the deformed part of the sheet touches and damages upper fixing belt 61 of fixing section 60A, or when fixing belt 61 draws the sheet from the deformed part, thus causing sheet winding jam.

The defect prevention control method may be carried out by, for example, conveying the sheet, by reducing the standby temperature of heating roller 62 of upper fixing section 60A, or by reducing the standby temperature of heating roller 62 of upper fixing section 60A while conveying the sheet. While the heating of the sheet at the time of fixation is performed with use of only upper fixing section 60A in the present embodiment, the heating may be performed with use of only lower fixing section 60B, and in this case, the standby temperature of lower fixing section 60B side is reduced. In addition, the heating may be performed with use of both upper fixing section 60A and lower fixing section 60B, and in this case, the heating is performed by upper fixing section 60A, or lower fixing section 60B or both. Temperature detection section 84 detects the temperature of heating roller 62 of upper fixing section 60A. Control section 101 performs the temperature control at heating roller 62 on the basis of a result of the temperature detection of temperature detection section 84.

In FIG. 1, sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 has a plurality of pairs of conveyance rollers including a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Continuous sheet P fed from sheet feeding apparatus 1 to image forming apparatus 2 is conveyed to image forming section 40 by conveyance path section 53. Then, in image forming section 40, the toner image on intermediate transfer belt 421 is secondary-transferred to one side of continuous sheet P at one time, and a fixing process is performed in fixing section 60. Continuous sheet P or sheet S on which an image has been formed is conveyed to winding apparatus 3 by sheet ejection section 52 having conveyance roller pair (sheet ejection roller pair) 52*a*.

Winding apparatus 3 is an apparatus for winding up continuous sheet P conveyed from image forming apparatus 2. As illustrated in FIG. 1, in the housing of winding apparatus 3, continuous sheet P is wound around a support shaft and held in a roll shape for example. As such, winding apparatus 3 winds up continuous sheet P which is conveyed from image forming apparatus 2 via a plurality of conveyance roller pairs (for example, delivery rollers and sheet ejection rollers) around the support shaft at a constant speed. The winding operation of winding apparatus 3 is controlled by control section 101 of image forming apparatus 2.

Next, the defect prevention control in the case where the part located at closest part NP2 of continuous sheet P is deformed is described with some examples.

First Control Example

Figure 7:
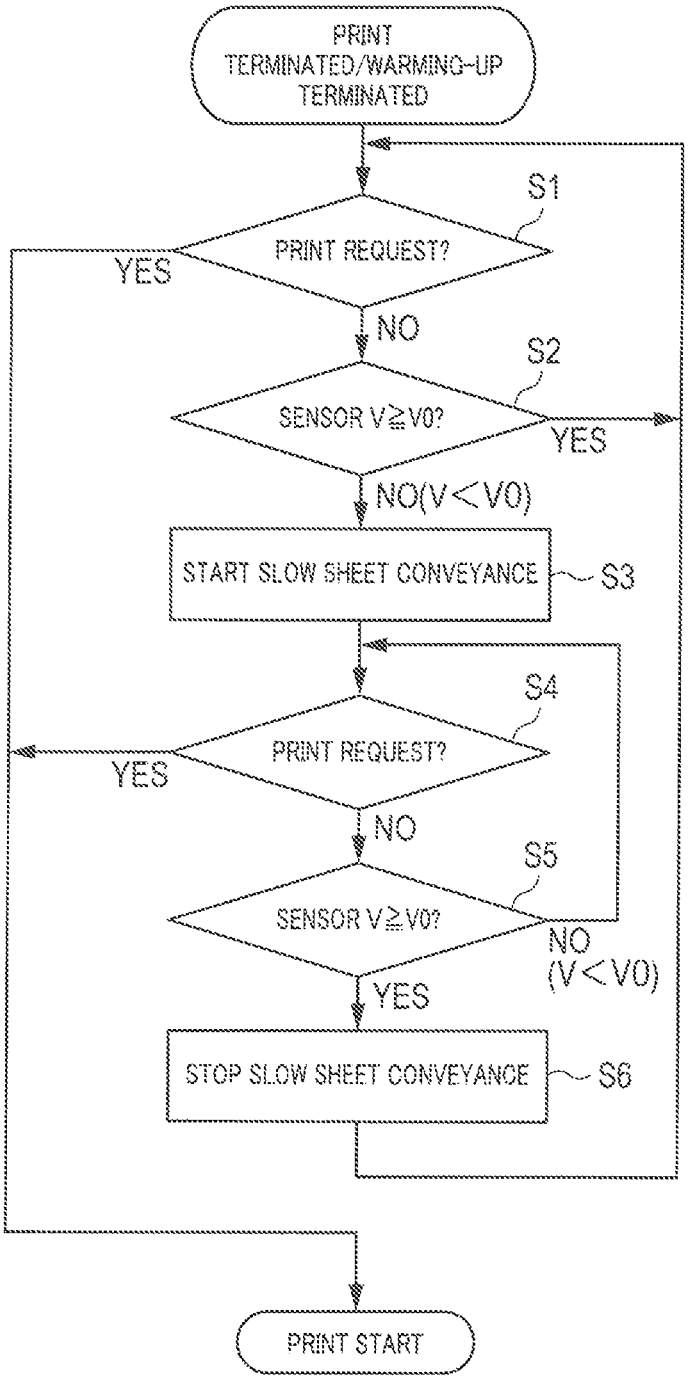
FIG. 7 is a flowchart of a first control example of the control section.

FIG. 7 is a flowchart of the first control example. In FIG. 7, control section 101 first determines whether a print request based on user operation has been received (step S1). When a print request has been received ("Yes" in the determination at step S1), control section 101 starts printing. When no print request has been received ("No" in the determination at step S1), control section 101 determines whether reception signal intensity V at reception section 60C2 of detection section 60C is not smaller than transmission signal intensity V0 at transmission section 60C1 (V≥V0) (at step S2). Here, while in practice transmission signal intensity V0 and reception signal intensity V are equal to each other when the signal is not diffused or shielded by the deformation of the sheet at the part located at closest part NP2 of continuous sheet P, reception signal intensity V is greater than transmission signal intensity V0 when some noise is applied to the output signal, and therefore, V≥V0 is used in determination at step S2.

When reception signal intensity V at reception section 60C2 is not smaller than transmission signal intensity V0 at transmission section 60C1 ("Yes" in the determination at step S2), control section 101 determines that the part located at closest part NP2 of continuous sheet P is not deformed and returns to the process of step S1. When reception signal intensity V at reception section 60C2 is smaller than transmission signal intensity V0 at transmission section 60C1 (V<V0) ("No" in the determination at step S2), control section 101 determines that the part located at closest part NP2 of continuous sheet P is deformed, and starts the conveyance of continuous sheet P at a speed slower than the normal conveyance speed (hereinafter referred to as "slow speed") (at step S3).

After performing a control of conveying continuous sheet P at the slow speed, control section 101 determines whether a print request has been received (at step S4). When a print request has been received ("Yes" in the determination at step S4), control section 101 starts printing. When no print request has been received ("No" in the determination at step S4), control section 101 determines whether reception signal intensity V at reception section 60C2 of detection section 60C is not smaller than transmission signal intensity V0 at transmission section 60C1 (V≥V0) (at step S5), and when reception signal intensity V at reception section 60C2 is not smaller than transmission signal intensity V0 at transmission section 60C1 ("Yes" in the determination at step S5), control section 101 determines that the part located at closest part NP2 of continuous sheet P is not deformed and stops the slow conveyance of continuous sheet P (at step S6). Specifically, when the deformed part is moved out from the detection area of detection section 60C (closest part NP2 in particular) as a result of the slow conveyance of continuous sheet P, and the subsequent part that is not deformed enters the detection area, no deformation is detected, and therefore the conveyance of continuous sheet P is stopped at this time point. Control section 101 stops the slow conveyance of continuous sheet P, and then returns to the process of step S1.

On the other hand, when it is determined at step S5 that reception signal intensity V at reception section 60C2 is smaller than transmission signal intensity V0 at transmission section 60C1 (V<V0) ("No" in the determination at step S5), control section 101 determines that the deformed part of continuous sheet P still remains at the detection area of detection section 60C, and returns to the process of step S4.

As described, according to the first control example, when continuous sheet P is partially deformed in a period in which no print request has been received, continuous sheet P is conveyed at a slow speed only until the deformed part is not detected, and thus the amount of waste of continuous sheet P can be minimized.

Second Control Example

Figure 8:
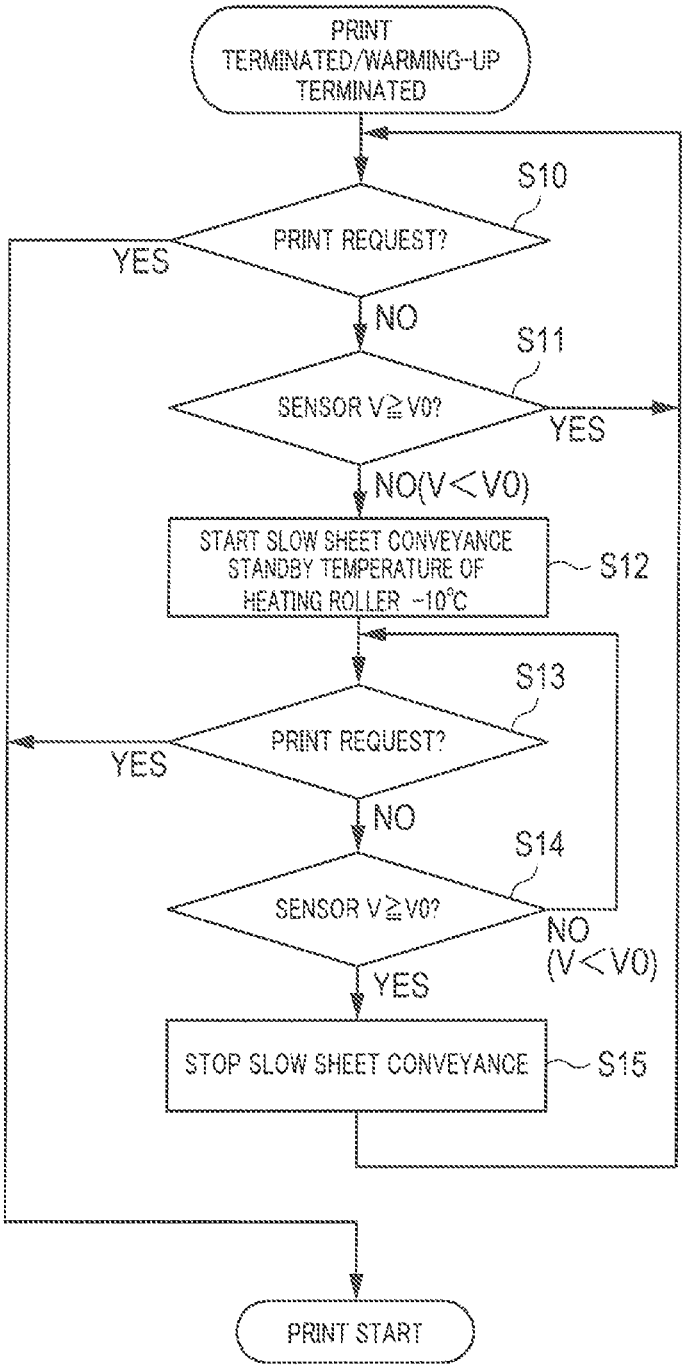
FIG. 8 is a flowchart of a second control example of the control section.

FIG. 8 is a flowchart of the second control example. In FIG. 8, control section 101 first determines whether a print request based on user operation has been received (at step S10). When a print request has been received ("Yes" in the determination at step S10), control section 101 starts printing. When no print request has been received ("No" in the determination at step S10), control section 101 determines whether reception signal intensity V at reception section 60C2 of detection section 60C is not smaller than transmission signal intensity V0 at transmission section 60C1 (V≥V0) (at step S11).

When reception signal intensity V at reception section 60C2 is not smaller than transmission signal intensity V0 at transmission section 60C1 ("Yes" in the determination at step S11), control section 101 determines that the part located at closest part NP2 of continuous sheet P is not deformed, and returns to the process of step S10. When reception signal intensity V at reception section 60C2 is smaller than transmission signal intensity V0 at transmission section 60C1 (V<V0) ("No" in the determination at step S11), control section 101 determines that the part located at closest part NP2 of continuous sheet P is deformed, and starts the conveyance of continuous sheet P at a speed (slow speed) slower than the normal conveyance speed, and further, sets the standby temperature of heating roller 62 to a temperature that is lower than the typical standby temperature by 10° C. (at step S12).

Control section 101 starts the slow conveyance of continuous sheet P, and lowers the standby temperature of heating roller 62, and thereafter, determines whether a print request has been received (at step S13). When a print request has been received ("Yes" in the determination at step S13), control section 101 starts printing. When no print request has been received ("No" in the determination at step S13), control section 101 determines whether reception signal intensity V at reception section 60C2 of detection section 60C is not smaller than transmission signal intensity V0 at transmission section 60C1 (V≥V0) (at step S14). When reception signal intensity V at reception section 60C2 is not smaller than transmission signal intensity V0 at transmission section 60C1 ("Yes" in the determination at step S14), control section 101 determines that the part located at closest part NP2 of continuous sheet P is not deformed, and stops the slow conveyance of continuous sheet P (at step S15). Specifically, when the deformed part is moved out from the detection area of detection section 60C as a result of the slow conveyance of continuous sheet P, and the subsequent part that is not deformed enters the detection area, no deformation is detected, and therefore the conveyance of continuous sheet P is stopped at this time point. After stopping the slow conveyance of continuous sheet P, control section 101 returns to the process of step S10.

The deformed part of continuous sheet P is moved out from closest part NP2 as a result of the conveyance of continuous sheet P, but when the succeeding part of continuous sheet P reaches closest part NP2, that part may be deformed under the influence of heat. However, in the second control example, the standby temperature of heating roller 62 is set to a temperature that is lower than the typical standby temperature by 10° C., and thus the possibility of deformation of the succeeding part of continuous sheet P under the influence of heat can be reduced. That is, since the succeeding part of continuous sheet P after the conveyance is not easily influenced by the heat by controlling the standby temperature of heating roller 62, the amount of waste paper can be further reduced.

On the other hand, when it is determined at step S14 that reception signal intensity V at reception section 60C2 is smaller than transmission signal intensity V0 at transmission section 60C1 (V<V0) ("No" in the determination at step S14), control section 101 determines that the deformed part of continuous sheet P still remains at the detection area of detection section 60C, and returns to step S13.

As described, according to the second control example, when continuous sheet P is partially deformed during a period in which no print request has been received, continuous sheet P is conveyed at a slow speed only until that part is not detected, and the standby temperature of heating roller 62 is set to a temperature that is lower than the typical standby temperature by 10° C., whereby the amount of waste of continuous sheet P can be minimized.

Third Control Example

Figure 9:
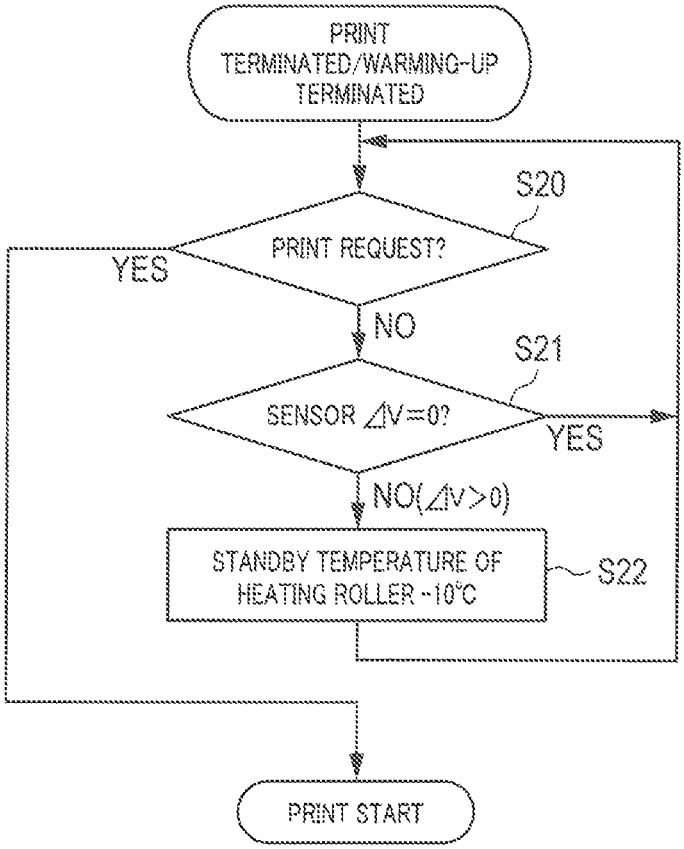
FIG. 9 is a flowchart of a third control example of the control section.

FIG. 9 is a flowchart of the third control example. In FIG. 9, control section 101 first determines whether a print request based on user operation has been received (at step S20). When a print request has been received ("Yes" in the determination at step S20), control section 101 starts printing. When no print request has been received ("No" in the determination at step S20), control section 101 determines whether reception signal intensity V at reception section 60C2 of detection section 60C is varied (whether ΔV=0 or not) (at step S21). That is, whether deformation is being formed is confirmed by checking the deformation speed.

When reception signal intensity V at reception section 60C2 is not varied ("Yes" in the determination at step S21 (ΔV=0, when it is not being deformed)), control section 101 determines that the part located at closest part NP2 of continuous sheet P is not deformed, and returns to the process of step S20. When reception signal intensity V at reception section 60C2 is varied ("No" in the determination at step S21 (ΔV>0, when it is being deformed)), control section 101 determines that the part located at closest part NP2 of continuous sheet P is deformed, and sets the standby temperature of heating roller 62 to a temperature that is lower than the typical standby temperature by 10° C. on the basis of a result of the temperature detection of temperature detection section 84 (at step S22). After lowering the standby temperature of heating roller 62, control section 101 returns to the process of step S20.

As described, according to the third control example, when continuous sheet P is being partially deformed during a period in which no print request has been received, the standby temperature of heating roller 62 is set to a temperature that is lower than the typical standby temperature by 10° C. without conveying continuous sheet P, and thus the generation of waste paper can be substantially prevented.

Fourth Control Example

Figure 10:
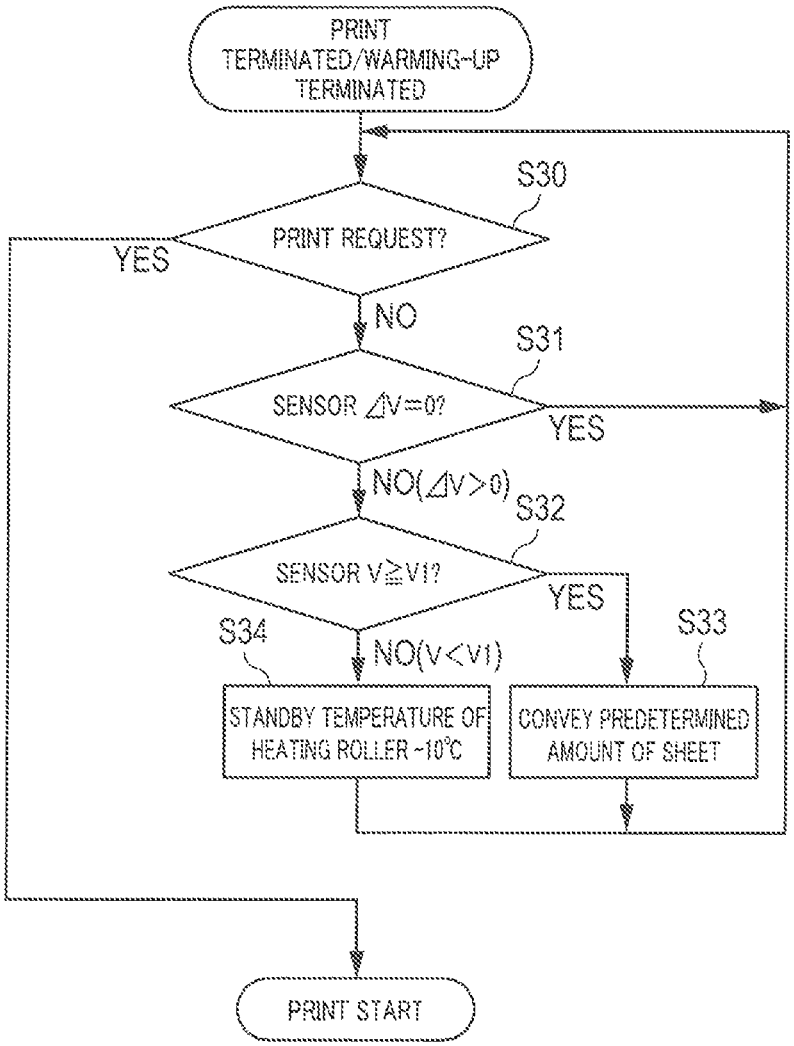
FIG. 10 is a flowchart of a fourth control example of the control section.

FIG. 10 is a flowchart of the fourth control example. In FIG. 10, control section 101 first determines whether a print request based on user operation has been received (at step S30). When a print request has been received ("Yes" in the determination at step S30), control section 101 starts printing. When no print request has been received ("No" in the determination at step S30), control section 101 determines whether reception signal intensity V at reception section 60C2 of detection section 60C is not varied (whether ΔV=0 or not) (at step S31). That is, the speed of the deformation of the part located at closest part NP2 of continuous sheet P is determined.

When reception signal intensity V at reception section 60C2 is not varied ("Yes (ΔV=0)" in the determination at step S31), control section 101 determines that the part located at closest part NP2 of continuous sheet P is not deformed, and returns to the process of step S30. When reception signal intensity V at reception section 60C2 is varied ("No (ΔV>0)" in the determination at step S31), control section 101 determines that the part located at closest part NP2 of continuous sheet P is deformed, and computes the amount of the deformation. That is, control section 101 determines whether reception signal intensity V at reception section 60C2 of detection section 60C is not smaller than threshold V1 for determination of the amount of the deformation (V≥V1) (at step S32). Here, threshold V1 is a value preliminarily set based on the transmission signal intensity of transmission section 60C1 and the reception signal intensity of reception section 60C2 at the time when the degree of the deformation of the sheet is determined to be greater than a given amount.

When reception signal intensity V at reception section 60C2 is not smaller than threshold V1 ("Yes" in the determination at step S32), control section 101 determines that the amount of the deformation is greater than a given amount, and conveys a predetermined amount of continuous sheet P (at step S33). After conveying a predetermined amount of continuous sheet P, control section 101 returns to the process of step S30.

When reception signal intensity V at reception section 60C2 is smaller than threshold V1 ("No" in the determination at step S32), control section 101 determines that the amount of the deformation is small (the deformation is not significant), and sets the standby temperature of heating roller 62 to a temperature that is lower than the typical standby temperature by 10° C. (at step S34). After lowering the standby temperature of heating roller 62, control section 101 returns to the process of step S30.

As described, according to the fourth control example, when continuous sheet P is being partially varied during a period in which no print request has been received and the amount of the deformation is greater than a given amount, a predetermined amount of continuous sheet P is conveyed, and thus the amount of waste of continuous sheet P can be minimized. In addition, when continuous sheet P is being partially varied and the amount of the deformation is not significant, the standby temperature of heating roller 62 is set to a temperature that is lower than the typical standby temperature by 10° C. without conveying continuous sheet P, and thus the generation of waste paper can be substantially prevented.

Fifth Control Example

Figure 11:
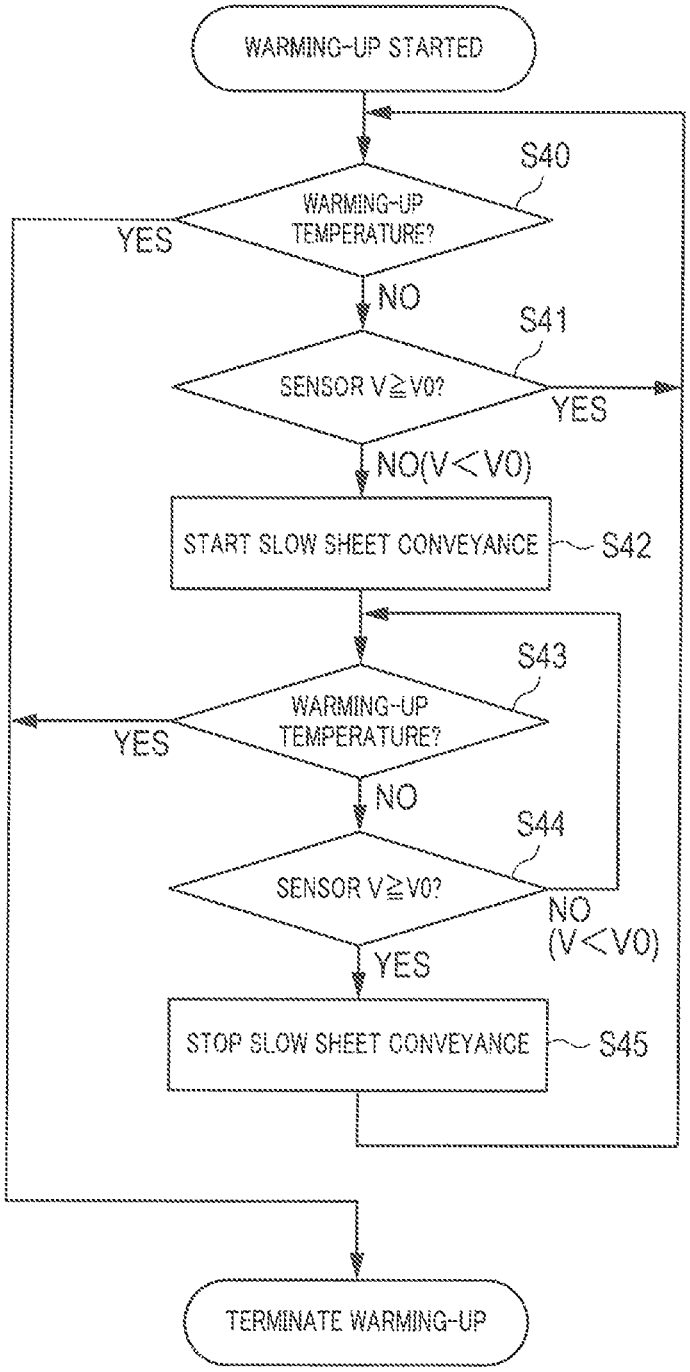
FIG. 11 is a flowchart of a fifth control example of the control section.

FIG. 11 is a flowchart of the fifth control example. In FIG. 11, when the power source of image formation system 100 is turned on, control section 101 starts the warming-up, and determines whether a warming-up temperature has been reached (at step S40). When the warming-up temperature has been reached ("Yes" in the determination at step S40), control section 101 terminates the warming-up. When the warming-up temperature has not been reached ("No" in the determination at step S40), control section 101 determines whether reception signal intensity V at reception section 60C2 of detection section 60C is not smaller than transmission signal intensity V0 at transmission section 60C1 (V≥V0) (at step S41).

When reception signal intensity V at reception section 60C2 is not smaller than transmission signal intensity V0 at transmission section 60C1 ("Yes" in the determination at step S41), control section 101 determines that the part located at closest part NP2 of continuous sheet P is not deformed, and returns to the process of step S40. When reception signal intensity V at reception section 60C2 is smaller than transmission signal intensity V0 at transmission section 60C1 (V<V0) ("No" in the determination at step S41), control section 101 determines that the part located at closest part NP2 of continuous sheet P is deformed, and starts the conveyance of continuous sheet P at a speed (slow speed) slower than the normal conveyance speed (at step S42).

After starting the slow conveyance of continuous sheet P, control section 101 determines whether the warming-up temperature has been reached (at step S43). When the warming-up temperature has been reached ("Yes" in the determination at step S43), control section 101 terminates the warming-up. When the warming-up temperature has not been reached ("No" in the determination at step S43), control section 101 determines whether reception signal intensity V at reception section 60C2 of detection section 60C is not smaller than transmission signal intensity V0 at transmission section 60C1 (V≥V0) (at step S44). When reception signal intensity V at reception section 60C2 is not smaller than transmission signal intensity V0 at transmission section 60C1 ("Yes" in the determination at step S44), control section 101 determines that the part located at closest part NP2 of continuous sheet P is not deformed, and stops the slow conveyance of continuous sheet P (at step S45). Specifically, when the deformed part is moved out from the detection area of detection section 60C as a result of the slow conveyance of continuous sheet P, and the subsequent part that is not deformed enters the detection area, no deformation is detected, and therefore the conveyance of continuous sheet P is stopped at this time point. After stopping the slow conveyance of continuous sheet P, control section 101 returns to the process of step S40.

On the other hand, when it is determined at step S44 that reception signal intensity V at reception section 60C2 is smaller than transmission signal intensity V0 at transmission section 60C1 (V<V0) ("No" in the determination at step S44), control section 101 determines that the deformed part of continuous sheet P still remains at the detection area of detection section 60C, and returns to step S43.

As described, according to the fifth control example, when continuous sheet P is partially deformed in a period until the warming-up temperature is reached, continuous sheet P is conveyed at a slow speed only until that part is not detected, and thus the amount of waste of continuous sheet P can be minimized.

Sixth Control Example

Figure 12:
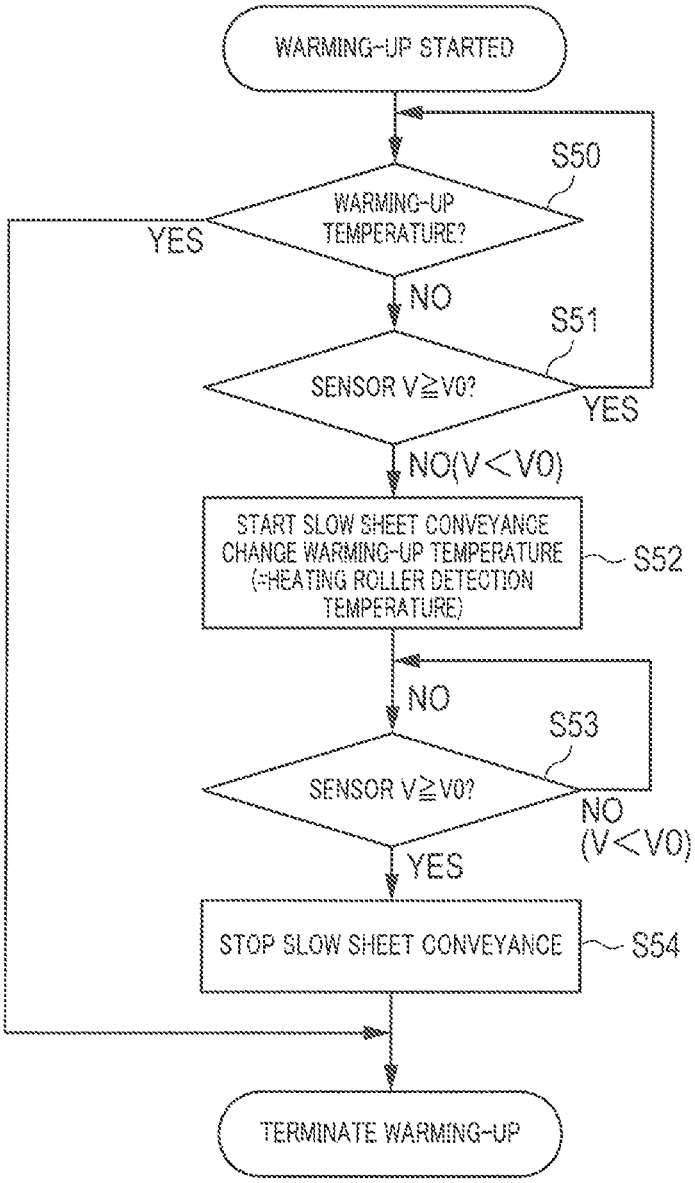
FIG. 12 is a flowchart of a sixth control example of the control section.

FIG. 12 is a flowchart of the sixth control example. In FIG. 12, when the power source of image formation system 100 is turned on, control section 101 starts the warming-up, and determines whether the warming-up temperature has been reached (at step S50). When the warming-up temperature has been reached ("Yes" in the determination at step S50), the warming-up is terminated. When the warming-up temperature has not been reached ("No" in the determination at step S50), control section 101 determines whether reception signal intensity V at reception section 60C2 of detection section 60C is not smaller than transmission signal intensity V0 at transmission section 60C1 (V≥V0) (at step S51).

When reception signal intensity V at reception section 60C2 is not smaller than transmission signal intensity V0 at transmission section 60C1 ("Yes" in the determination at step S51), control section 101 determines that the part located at closest part NP2 of continuous sheet P is not deformed, and returns to the process of step S50. When reception signal intensity V at reception section 60C2 is smaller than transmission signal intensity V0 at transmission section 60C1 (V<V0) ("No" in the determination at step S51), control section 101 determines that the part located at closest part NP2 of continuous sheet P is deformed, and starts the conveyance of continuous sheet P at a speed (slow speed) slower than the normal conveyance speed, and detects the temperature of heating roller 62 at which continuous sheet P is partially deformed and changes the warming-up temperature to the detected temperature (at step S52). That is, since the part located at closest part NP2 of continuous sheet P is deformed even when the normal warming-up temperature has not been reached, the conveyance of continuous sheet P at a slow speed is started, and the warming-up temperature is changed to the current temperature of heating roller 62. It is to be noted that temperature detection section 84 for detecting the temperature of heating roller 62 is provided in the present embodiment (see FIG. 2), and control section 101 performs a process of changing the warming-up temperature on the basis of a result of the detection of temperature detection section 84.

Control section 101 starts the slow conveyance of continuous sheet P and changes the warming-up temperature, and thereafter, determines whether reception signal intensity V at reception section 60C2 of detection section 60C is not smaller than transmission signal intensity V0 at transmission section 60C1 (V≥V0) (at step S53). When reception signal intensity V at reception section 60C2 is not smaller than transmission signal intensity V0 at transmission section 60C1 ("Yes" in the determination at step S53), control section 101 determines that the part located at closest part NP2 of continuous sheet P is not deformed, and stops the slow conveyance of continuous sheet P (at step S54). Specifically, when the deformed part is moved out from the detection area of detection section 60C as a result of the slow conveyance of continuous sheet P, and the subsequent part that is not deformed enters the detection area, no deformation is detected, and therefore the conveyance of continuous sheet P is stopped at this time point. After stopping the slow conveyance of continuous sheet P, control section 101 terminates the warming-up.

On the other hand, when it is determined at step S53 that reception signal intensity V at reception section 60C2 is smaller than transmission signal intensity V0 at transmission section 60C1 (V<V0) ("No" in the determination at step S53), the determination of step S53 is continued until the deformed part of continuous sheet P leaves the detection area of detection section 60C, that is, until reception signal intensity V at reception section 60C2 is changed to a value not smaller than transmission signal intensity V0 at transmission section 60C 1.

As described, according to the sixth control example, when continuous sheet P is partially deformed in a period until the warming-up temperature is reached, continuous sheet P is conveyed at a slow speed only until that part is not detected, and thus the amount of waste of continuous sheet P can be minimized. In addition, since the warming-up temperature is changed to the temperature of heating roller 62 at which continuous sheet P is partially deformed, it is possible to prevent continuous sheet P from being partially deformed in the period until the warming-up temperature is reached.

Seventh Control Example

Figure 13:
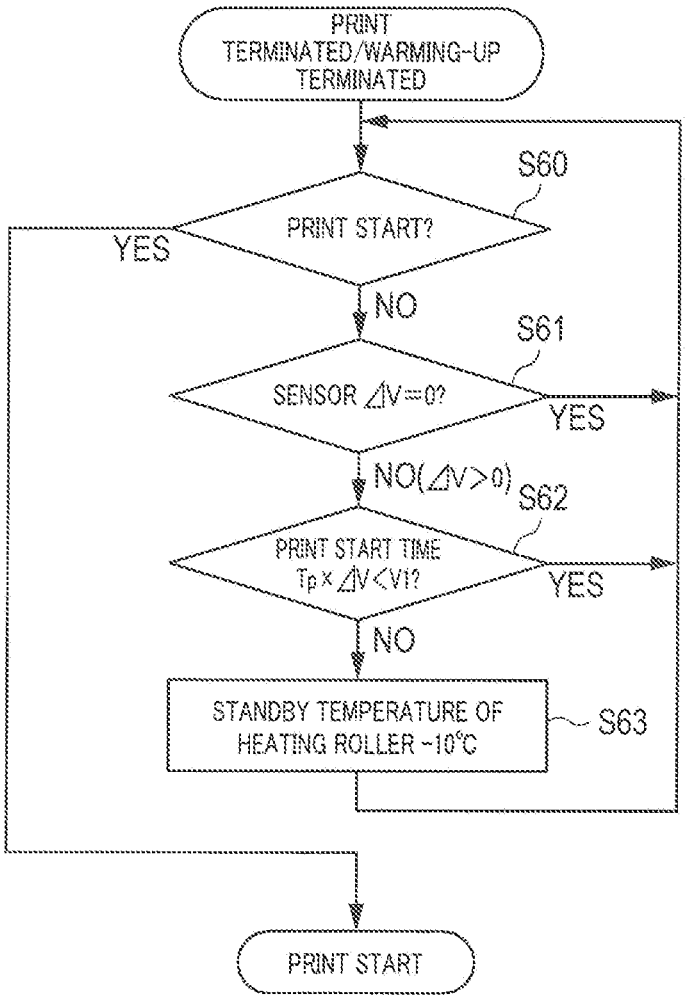
FIG. 13 is a flowchart of a seventh control example of the control section.

FIG. 13 is a flowchart of the seventh control example. In FIG. 13, control section 101 first determines whether print start or not (at step S60). Here, the seventh control example assumes the case where a plurality of print jobs are provided, and when a plurality of print jobs are provided and set to be executed at constant intervals, the start time of the next print job can sometimes be grasped from the remaining time. For example, when the reservation time of the print start is set, the remaining time until the start of the next printing can be calculated from the difference from the present time. It is possible to determine whether the print start or not by acquiring the remaining time.

When print start is performed ("Yes" in the determination at step S60), control section 101 starts printing. When print start is not performed ("No" in the determination at step S60), control section 101 determines whether reception signal intensity V at reception section 60C2 of detection section 60C is varied (whether ΔV=0 or not) (at step S61). That is, whether deformation is not being caused is confirmed by checking the deformation speed.

When reception signal intensity V at reception section 60C2 is not varied ("Yes" in the determination at step S61 (ΔV=0, when deformation is not being caused)), control section 101 determines that the part located at closest part NP2 of continuous sheet P is not deformed, and returns to the process of step S60. When reception signal intensity V at reception section 60C2 is varied ("No" in the determination at step S61 (ΔV>0, when deformation is being caused)), control section 101 estimates the amount of sheet deformation at the print start on the basis of the time until print start (Tp) and sheet deformation speed (ΔV), and determines whether the estimated value is smaller than threshold V1 (V1: the upper limit for preventing continuous sheet P from making contact with heating roller 62 for example) (at step S62). When the estimated value is smaller than V1 ("Yes" in the determination at step S62), the processing is returned to the process of step S60. When the estimated value is not smaller than V1 ("No" in the determination at step S62), control section 101 sets the standby temperature of heating roller 62 to a temperature that is lower than the typical standby temperature by 10° C. (at step S63) on the basis of a result of the temperature detection of temperature detection section 84. After lowering the standby temperature of heating roller 62, control section 101 returns to the process of step S60.

As described, according to the seventh control example, when continuous sheet P is being partially varied during a period in which no print request has been received, and the estimated value of the amount of sheet deformation at the print start is not smaller than the threshold (the upper limit for preventing continuous sheet P from making contact with heating roller 62) V1, the standby temperature of heating roller 62 is set to a temperature that is lower than the typical standby temperature by 10° C. without conveying continuous sheet P, and thus the generation of waste paper can be substantially prevented.

According to the above-mentioned configuration of the present embodiment, detection section 60C configured to detect deformation of continuous sheet P at closest part NP2 between upper fixing section 60A and lower fixing section 60B is provided. When the detection section 60C detects deformation of continuous sheet P at closest part NP2, conveyance of continuous sheet P, or reduction of the standby temperature of heating roller 62 of upper fixing section 60A by 10° C. from the normal temperature, or both is performed on the basis of the degree of the detected deformation. Since the above-mentioned defect prevention controls can be performed on the basis of the degree of the deformation of continuous sheet P, continuous sheet P can be prevented from being partially deformed as much as possible, and the amount of waste paper can be reduced in the case where continuous sheet P is partially deformed.

While upper fixing section 60A includes fixing belt 61, fixing roller 63 and heating roller 62 in the above-mentioned embodiment, it is also possible to adopt a configuration in which upper fixing section 60A has only heating roller 62 that functions as the fixing side member.

REFERENCE SIGNS LIST

1 Sheet feeding apparatus
2 Image forming apparatus
3 Winding apparatus
10 Image reading section
20 Operation display section
21 Display section
22 Operation section
30 Image processing section
40 Image forming section
50 Sheet conveyance section
60 Fixing section
60A Upper fixing section
60B Lower fixing section
60C Detection section
60C1 Transmission section
60C2 Reception section
61 Fixing belt
62 Heating roller
63 Fixing roller
64 Pressure roller
71 Communication section
72 Storage section
80 Pressure contact separation section
84 Temperature detection section
100 Image formation system
101 Control section
102 CPU
103 ROM
104 RAM

What is claimed is:

1. An image forming apparatus comprising:

an upper fixing section disposed on a fixing side of a continuous sheet on which a toner image is formed;

a lower fixing section configured to form a fixing nip for conveying the continuous sheet in a tightly sandwiching manner in a state where the lower fixing section makes pressure contact with the upper fixing section;

a control section configured to control separation of the upper fixing section and the lower fixing section from each other during a non-image formation period; and a detection section configured to detect deformation of the continuous sheet at a closest part between the upper fixing section and the lower fixing section during the non-image formation period.

2. The image forming apparatus according to claim 1, wherein the control section performs a control of conveying the continuous sheet on a basis of a degree of deformation of the continuous sheet which is detected by the detection section.

3. The image forming apparatus according to claim 1, wherein the control section performs a control of lowering a temperature of the upper fixing section or the lower fixing section or both on a basis of a degree of deformation of the continuous sheet which is detected by the detection section.

4. The image forming apparatus according to claim 1, wherein the detection section includes:

a transmission section configured to output a signal at a position on one of an upstream side and a downstream side in a conveyance direction of the continuous sheet; and a reception section configured to receive the signal output from the transmission section at a position on the other one of the upstream side and the downstream side in the conveyance direction of the continuous sheet; wherein the detection section is disposed on the upper fixing section side, or the lower fixing section side, or both with respect to the continuous sheet.

5. The image forming apparatus according to claim 4, wherein the transmission section and the reception section are disposed so as to form a signal propagation path that has a V-shape and turns at the closest part.

6. The image forming apparatus according to claim 4, wherein the transmission section and the reception section are disposed so as to form a signal propagation path that is parallel to the continuous sheet.

7. An image formation system comprising:

a sheet feeding apparatus configured to feed a continuous sheet;

the image forming apparatus according to claim 1 configured to form an image on the continuous sheet fed from the sheet feeding apparatus; and a winding apparatus configured to wind up the continuous sheet on which an image is formed by the image forming apparatus.

8. The image formation system according to claim 7, wherein the control section performs a control of conveying the continuous sheet on a basis of a degree of deformation of the continuous sheet which is detected by the detection section.

9. The image formation system according to claim 7, wherein the control section performs a control of lowering a temperature of the upper fixing section or the lower fixing section or both on a basis of a degree of deformation of the continuous sheet which is detected by the detection section.

10. The image formation system according to claim 7, wherein the detection section includes:

a transmission section configured to output a signal at a position on one of an upstream side and a downstream side in a conveyance direction of the continuous sheet; and a reception section configured to receive the signal output from the transmission section at a position on the other one of the upstream side and the downstream side in the conveyance direction of the continuous sheet; wherein the detection section is disposed on the upper fixing section side, or the lower fixing section side, or both with respect to the continuous sheet.

11. The image formation system according to claim 10, wherein the transmission section and the reception section are disposed so as to form a signal propagation path that has a V-shape and turns at the closest part.

12. The image formation system according to claim 10, wherein the transmission section and the reception section are disposed so as to form a signal propagation path that is parallel to the continuous sheet.

13. A fixing device comprising:

an upper fixing section disposed on a fixing side of a continuous sheet on which a toner image is formed;

a lower fixing section configured to form a fixing nip for conveying the continuous sheet in a tightly sandwiching manner in a state where the lower fixing section makes pressure contact with the upper fixing section;

a control section configured to control separation of the upper fixing section and the lower fixing section from each other during a non-image formation period; and a detection section configured to detect deformation of the continuous sheet at a closest part between the upper fixing section and the lower fixing section during the non-image formation period.

14. The fixing device according to claim 13, wherein the control section performs a control of conveying the continuous sheet on a basis of a degree of deformation of the continuous sheet which is detected by the detection section.

15. The fixing device according to claim 13, wherein the control section performs a control of lowering a temperature of the upper fixing section or the lower fixing section or both on a basis of a degree of deformation of the continuous sheet which is detected by the detection section.

16. The fixing device according to claim 13, wherein the detection section includes:

a transmission section configured to output a signal at a position on one of an upstream side and a downstream side in a conveyance direction of the continuous sheet; and a reception section configured to receive the signal output from the transmission section at a position on the other one of the upstream side and the downstream side in the conveyance direction of the continuous sheet; wherein the detection section is disposed on the upper fixing section side, or the lower fixing section side, or both with respect to the continuous sheet.

17. The fixing device according to claim 16, wherein the transmission section and the reception section are disposed so as to form a signal propagation path that has a V-shape and turns at the closest part.

18. The fixing device according to claim 16, wherein the transmission section and the reception section are disposed so as to form a signal propagation path that is parallel to the continuous sheet.

* * * * *